United States Patent [19]

Larson et al.

[11] 4,342,593

[45] Aug. 3, 1982

[54] CASTINGS

[75] Inventors: Hugo R. Larson, Ridgewood; Howard S. Avery; Henry J. Chapin, both of Mahwah, all of N.J.

[73] Assignee: Abex Corporation, New York, N.Y.

[21] Appl. No.: 187,341

[22] Filed: Sep. 15, 1980

[51] Int. Cl.[3] ..... C22C 38/58; E01B 7/10

[52] U.S. Cl. ..... 75/128 A; 148/38; 148/137; 246/468

[58] Field of Search ..... 75/128 A, 126 B, 123 N; 148/137, 38; 246/468

[56] References Cited

U.S. PATENT DOCUMENTS

| | | | |
|---|---|---|---|
| 1,732,202 | 10/1929 | Hall et al. | 148/137 |
| 3,075,838 | 1/1963 | Avery et al. | 75/123 R |
| 3,383,203 | 5/1968 | Baggström | 148/38 |
| 3,574,605 | 4/1971 | Hall et al. | 75/128 A |
| 4,039,328 | 8/1977 | Novomeisky et al. | 75/126 B |

FOREIGN PATENT DOCUMENTS

| | | | |
|---|---|---|---|
| 2024862 | 1/1980 | United Kingdom | 75/128 A |

*Primary Examiner*—Peter K. Skiff

*Attorney, Agent, or Firm*—Kinzer, Plyer, Dorn & McEachran

[57] ABSTRACT

Ferrous metal casting of manganese steel susceptible to austenization to develop minimum yield strength of about 75,000 psi and elongation of about 30% min. consisting essentially of:

C—0.85
Mn—14
Si—0.6
Cr—4
Ni—3.6
V—0.4 balance essentially iron except for impurities.

3 Claims, 2 Drawing Figures

CASTINGS

Figure 1:
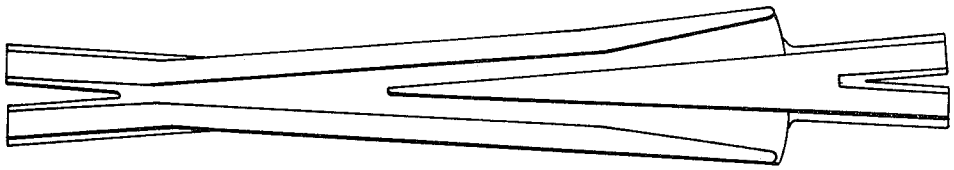

This invention relates to the metallurgy of manganese steel castings and in particular trackwork castings including frogs and crossings.

Trackwork installations in the form of frogs and crossings are usually of austenitic manganese steel, selected for its ability to work harden. Thus, when plastically deformed as by impact from the wheel of a fast moving railroad car, the casting becomes harder at the impacted section and consequently is more difficult to deform. Nominally the alloy will be about 0.9 to 1.4 percent carbon, eleven to fourteen percent manganese, heat treated at about 1900° F. and quenched to develop the best properties, usually 50,000 to 55,000 yield strength and around forty percent (or better) elongation.

The initial deformation of the trackwork casting results in depression of the running surface of the rail and flow of metal at unsupported edges, requiring maintenance after installation. With present-day one hundred ton cars the problem is severe.

One object of the invention is to produce the manganese steel alloy with greater yield strength and favorable elongation, better to resist the one hundred ton car load while retaining good ductility, and so reducing the need for maintenance.

Another object of the present invention is to develop an alloy which will not only have the higher yield strength combined with acceptable ductility, even in heavy or thick sections, better able to withstand high impact loading, but also one having reproducible response to heat treatment (both solution and aging).

There have been earlier attempts to enhance the yield strength of manganese steel. Avery and Chapin (U.S. Pat. No. 3,075,838) heat treated after austenitizing (as we do) and reported exceptionally high yield strength but elongation was reduced considerably.

Baggstrom (U.S. Pat. No. 3,383,203) reported a composition quite close to ours but his heat treatment embrittles the alloy as we shall show.

We were also aware of an effort by some of our colleagues to achieve the superior properties by a combination of nickel, chromium and vanadium, and while high yield strength combined with acceptable elongation was obtained, the response to heat treatment was variable with unpredictable results. The effort was therefore discontinued.

An object of the present invention, an increase in yield strength to about 75,000 psi min. with acceptable ductility, economically practical, is achieved by matching a narrow-band alloy modification to a narrow-band solution heat treatment (austenitizing) which precedes a narrow-band aging heat treatment, all with reproducible (predictable) results.

We have found that the highly desirable combination of about 75,000 psi min. yield strength and about 30% min. elongation (good ductility for such strength) can be obtained by a careful balance of the principal elements of the alloy (especially carbon and vanadium) while relying on very narrow ranges of temperature during the solution and aging heat treatment, proven to produce reproducible results. Specifically it has been found that if the alloy (preferred) is restricted substantially to (percent by weight):

Carbon—0.85
Manganese—14
Silicon—0.6
Chromium—4
Nickel—3.6
Vanadium—0.4
balance substantially iron except for impurities and tramp elements that alloy can be heat-treated to achieve about 75,000 psi min. yield strength and about 30 percent elongation (min.) under the following schedule: austenitize at 2050° F. for two hours and water quench, followed by aging at 1000° F. for ten hours.

Figure 2:
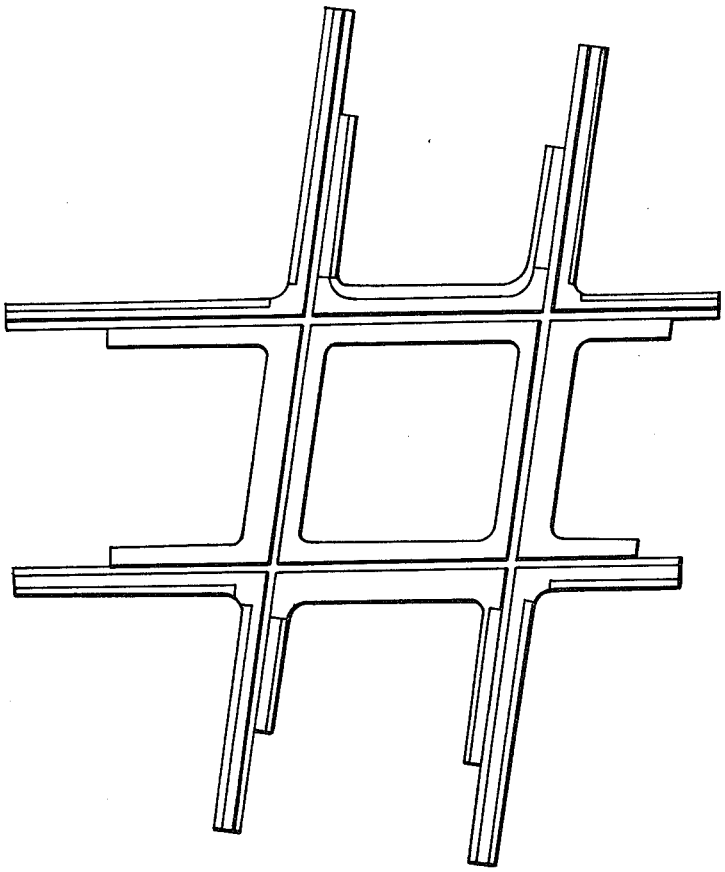

There can be a permissive variance in temperature on either the low or high side during each phase of heat treatment, depending on the time at temperature. Hence there are infinite equivalent schedules for the two hours austenitizing treatment (min. 2000° F.) and the ten hour aging treatment within the range of about 950° to 1100° F. Nonetheless the heat treatment specified is unique to a particular alloy as will be shown. The following foundry variance is permissible without substantially altering the desirable combination of yield strength and elongation:

Carbon—0.8/0.9
Manganese—10/18
Silicon—0.2/1.2
Vanadium—0.3/0.5
Chromium—3.5–4.5
Nickel—3.4–4.0
balance substantially iron except for impurities and tramp elements In the drawing:

FIGS. 1 and 2 are plan views of typical railroad trackwork castings to which the present invention may be applied.

The effect of the aging heat treatment on the present alloy (MVB alloy) can be seen from the following data:

TABLE I

EFFECT OF AGING TEMPERATURE ON MECHANICAL PROPERTIES OF ONE INCH DIAMETER (D-14) 0.4%V MVB Mn STEEL

| Heat No. | C | Mn | Si | Cr | V | Ni | P | S | Al |
|---|---|---|---|---|---|---|---|---|---|
| 78-031 | .85 | 14.21 | .49 | 3.83 | .46 | 3.51 | .020 | .017 | .051 |

A. AUSTENITIZED AT 2050° F.-2 HRS-WQ

| Specimen ID | Aging Treatment | YS,psi | TS,psi | % El | % RA | BHN |
|---|---|---|---|---|---|---|
| 78-031-4 | None | 58750 | 121400 | 64.5 | 53.0 | 192 |
| 78-031-8 | 900° F.-10 hrs-AC | 66120 | 120000 | 56.5 | 51.9 | 207 |
| 78-031-9 | 950° F.-10 hrs-AC | 70920 | 119000 | 51.5 | 41.0 | 217 |
| 78-031-5 | 1000° F.-10 hrs-AC | 77040 | 115000 | 35.0 | 34.1 | 228 |
| 78-031-6 | 1050° F.-10 hrs-AC | 78960 | 108000 | 26.5 | 29.2 | 235 |
| 78-031-7 | 1100° F.-10 hrs-AC | 83520 | 109000 | 23.5 | 25.1 | 241 |
| 78-031-10 | 1100° F.-2½ hrs-AC | 75320 | 111000 | 33.5 | 35.2 | 217 |

TABLE I-continued

| EFFECT OF AGING TEMPERATURE ON MECHANICAL PROPERTIES OF ONE INCH DIAMETER (D-14) 0.4%V MVB Mn STEEL | | | | | | |
|---|---|---|---|---|---|---|
| 78-031-11 | 1100° F.- hrs-AC | 80550 | 112500 | 30.0 | 31.0 | 228 |
| | B. AUSTENITIZED AT 2000° F.-2 HRS-WQ | | | | | |
| 78-031-12 | 950° F.-10 hrs-AC | 70080 | 117000 | 44.5 | 43.7 | 217 |
| 78-031-13 | 1000° F.-10 hrs-AC | 73680 | 115500 | 38.0 | 37.0 | 228 |
| 78-031-14 | 1050° F.-10 hrs-AC | 74880 | 106500 | 27.5 | 30.8 | 235 |

The lower austenitizing temperature (2000° F.) may require a higher aging temperature or a longer aging time to achieve the desired properties. The higher austenitizing temperature (2050° F.) is preferred since it permits greater flexibility in the subsequent aging conditions. On the other hand, specimen 78-031-5 exhibited optimum values.

Substantially the same results are achieved by reducing vanadium to about 0.35:

TABLE II

| Heat No. | C% | Mn% | Si% | Cr% | V% | Ni% | P% | Al% |
|---|---|---|---|---|---|---|---|---|
| 78-535 | .86 | 14.20 | .49 | 3.96 | .34 | 3.54 | .029 | .070 |

| Specimen ID* | Aging Treatment** | YS,psi | TS,psi | %El | %RA | BHN |
|---|---|---|---|---|---|---|
| 78-535-5 | None | 58800 | 117000 | 61.0 | 52.2 | 202 |
| 78-535-6 | 1000° F.-10 Hrs.-AC | 76440 | 113500 | 33.0 | 36.0 | 235 |

*All test bars are 1"ϕ D-14 castings
**All test bars austenitized 2050° F.-2 Hrs.-WQ prior to aging.

The heat treatment preference is to solution heat-treat at 2050° F. for two hours, quench, and then age at 1000° F. for ten hours but it is clear there can be a slight variance, high or low, in both temperature and time while still attaining about 75,000 psi yield strength and about 30% elongation (min.).

The alloy of Baggstrom, as noted, is quite close. One difference resides in a greater amount of nickel and vanadium employed by Baggstrom. His heat treatment produces a catastrophic effect on the alloy; this is shown by the following data where heat 79-552 had a composition as close as possible to the present alloy while still within the limits set by Baggstrom:

TABLE III

| | Heat 79-552 (% by weight) | | | | | |
|---|---|---|---|---|---|---|
| | C% | Mn% | Si% | Cr% | Ni% | V% |
| Present Alloy:(1) | 0.85 ±.04 | 14.00 ±0.50 | 0.60 ±0.20 | 4.00 ±0.20 | 3.60 ±0.10 | 0.40 ±0.07 |
| Baggstrom: | 0.50 | 9.0 | 0.50 | 2.0 | 7.0 | 0.60 |
| | 0.80 | 18.0 | 0.80 | 6.0 | 11.0 | 1.00 |
| Aim: | 0.8 | 13.0 | 0.50 | 4.0 | 7.3 | 0.65 |
| Analysis: | 0.78 | 13.50 | 0.60 | 4.14 | 7.57 | 0.61 |

TABLE III-continued

| | Heat 79-552 (% by weight) | | | | | |
|---|---|---|---|---|---|---|
| | C% | Mn% | Si% | Cr% | Ni% | V% |
| Procedure: | 0.08% Al to furnace before tap. Tapped onto 0.25% CaSi in ladle. 0.65% V as Ferrovan at ½ tap. Tapped: 3050° F. Poured: 2800° F. | | | | | |
| Heat Treatment | | | | | | |
| Present | 2050° F. - 2 hours - water quench; 1000° F. - 10 hours - air cool | | | | | |
| Baggstrom | 2100° F. - 1 hour - water quench; 1200° F. - 10 hours - air cool | | | | | |

(1)tolerances are foundry allowances

TENSILE DATA ON 1-INCH SECTION MATERIAL 79-552

| Indentification | Heat Treatment | Yield Strength PSI | Tensile Strength PSI | % Elongation | % Reduction of Area |
|---|---|---|---|---|---|
| 79-552-3 | 2100° F.-1 Hr. W.Q., 1200° F. 10 Hr.-A.C. | 24,700 | 24,700 | 0 | 1.6 |
| 79-552-4 | | 24,360 | 24,400 | 0 | 1.9 |
| 79-552-5 | | 101,880 | 105,000 | 3.0 | 16.3 |
| 79-552-6 | 2050° F.-2 Hr. W.Q., 1000° F. 10 Hr.-A.C. | 79,800 | 115,000 | 30.5 | 36.0 |
| 79-552-7 | | 78,360 | 113,100 | 27.5 | 37.0 |
| 79-552-8 | | 80,640 | 118,000 | 35.0 | 37.6 |

It can be seen from the tensile data set forth immediately above that the heat treatment of Baggstrom when applied to a Baggstrom alloy as close as possible to ours produces a wide, unpredictable variance in properties, considerably mollified by the heat treatment of the present invention.

Typical trackwork castings to which the present invention may be applied are shown in FIG. 1 (a frog) and in FIG. 2 (a crossing) each of which has sections more than an inch in thickness.

Vanadium may be added as ferrovanadium together with revert or scrap from a previous heat; it may also be added as FEROVAN vanadium additive which is supplied by Foote Mineral Company.

We claim:

1. Ferrous metal casting having a minimum yield strength of about 75,000 psi and a minimum elongation of about 30%, consisting essentially of:

C—0.85
Mn—14
Si—0.6
Cr—4
Ni—3.6
V—0.4 balance essentially iron except for impurities.

2. A casting according to claim 1 in the form of a railroad frog or crossing.

3. A casting according to claim 1 or 2 having sections at least three inches thick, austenitized at 2050° F. for two hours followed by a water quench and then aged at 1000° F. for ten hours.

* * * * *

UNITED STATES PATENT AND TRADEMARK OFFICE

CERTIFICATE OF CORRECTION

PATENT NO. : 4,342,593

DATED : August 3, 1982

INVENTOR(S) : Hugo R. Larson, Howard S. Avery and Henry J. Chapin

It is certified that error appears in the above—identified patent and that said Letters Patent is hereby corrected as shown below:

Col. 3, fourth line, after "1100°F" change "hrs-AC" to --5 hrs-AC--

Signed and Sealed this

*Fifth* Day of *October 1982*

[SEAL]

*Attest:*

GERALD J. MOSSINGHOFF

*Attesting Officer*

*Commissioner of Patents and Trademarks*